US005529893A

United States Patent [19]

Valsecchi et al.

[11] Patent Number: 5,529,893

[45] Date of Patent: Jun. 25, 1996

[54] PHOTOGRAPHIC ELEMENTS COMPRISING ANTISTATIC LAYERS

[75] Inventors: Alberto Valsecchi, Vado Ligure; Elio Martino, Carcare; Paola Puppo, Cogoleto, all of Italy; Eric D. Morrison, Minneapolis, Minn.

[73] Assignee: Minnesota Mining and Manufacturing Company, St. Paul, Minn.

[21] Appl. No.: 507,548

[22] Filed: Jul. 26, 1995

[30] Foreign Application Priority Data

Sep. 28, 1994 [EP] European Pat. Off. ..... 94115250

[51] Int. Cl.[6] ..... G03C 1/89

[52] U.S. Cl. ..... 430/529; 430/533; 430/534

[58] Field of Search ..... 430/527, 529, 430/533, 534

[56] References Cited

U.S. PATENT DOCUMENTS

| | | | |
|---|---|---|---|
| 3,071,466 | 1/1963 | Klockgether et al. | 430/535 |
| 3,615,552 | 10/1971 | Danhäuser et al. | 430/534 |
| 4,225,665 | 9/1980 | Schadt, III | 430/529 |
| 4,424,273 | 1/1984 | Franco et al. | 430/534 |
| 4,459,352 | 7/1984 | Jones et al. | 430/529 |
| 5,096,975 | 3/1992 | Anderson et al. | 430/529 |
| 5,126,405 | 6/1992 | Jones et al. | 525/100 |

FOREIGN PATENT DOCUMENTS

| | | |
|---|---|---|
| 0066100A2 | 12/1982 | European Pat. Off. . |
| 0486982A1 | 5/1992 | European Pat. Off. . |
| 663984 | 5/1965 | France . |

OTHER PUBLICATIONS

International Application Published under the PCT on Dec. 9, 1993 as Publication No. WO 93/24322.

*Primary Examiner*—Lee C. Wright

*Attorney, Agent, or Firm*—Gary L. Griswold; Walter N. Kirn; Mark A. Litman

[57] ABSTRACT

Light-sensitive photographic element comprising a polymeric film base, a silver halide emulsion layer, and an antistatic layer comprising a low viscosity and highly sulfonated water soluble polyacetal (preferably obtained by reaction of a low viscosity polyvinyl alcohol and a sulfonated aldehyde), a hydrophobic binder selected from the group consisting of a water dispersible sulfopolyester and a latex polymer having hydrophilic functionality, and a polyfunctional aldehyde crosslinking agent. The antistatic layer may be present as a backing layer on the side of the base opposite the silver halide emulsion layer, as a subbing layer between the base and the emulsion layer in a single or double side coated photographic element, and/or as a subbing layer between the base and a different backing layer.

16 Claims, No Drawings

PHOTOGRAPHIC ELEMENTS COMPRISING ANTISTATIC LAYERS

FIELD OF THE INVENTION

The present invention relates to light-sensitive photographic elements comprising antistatic layers, and in particular to light-sensitive photographic elements comprising antistatic layers containing an electrically conductive polymer.

BACKGROUND OF THE ART

The use of polymeric film bases for carrying photographic layers is well known. In particular, photographic elements which require accurate physical characteristics use polyester film bases, such as polyethyleneterephthalate film bases or polyethylenenaphthalate film bases, and cellulose ester film bases, such as cellulose triacetate film bases.

It is known that the formation of static electric charges on the film base is a serious problem in the production of photographic elements. While coating the light-sensitive emulsion, electric charges which accumulate on the base discharge, producing light which is recorded as an image on the light-sensitive layer. Other drawbacks which result from the accumulation of electric charges on polymeric film bases are the adherence of dust and dirt, coating defects and limitation of coating speed.

Additionally, photographic elements comprising light-sensitive layers coated onto polymeric film bases, when used in rolls or reels which are mechanically wound and unwound or in sheets which are conveyed at high speed, tend to accumulate static charges and record the light generated by the static discharges.

The static-related damages occur not only before the photographic element has been manufactured, exposed and processed, but also after processing when the photographic element including the image is used to reproduce and enlarge the image. Accordingly, it is desired to provide permanent antistatic protection which retains its effectiveness even after processing.

To overcome the adverse effects resulting from accumulation of static electrical charges, it is known to provide photographic elements with antistatic layers including electrically conductive materials which are capable of transporting charges away from areas where they are not desired. Typically, such antistatic layers contain electrically conductive substances, in particular polyelectrolites such as the alkali metal salts of polycarboxylic acids or polysulfonic acids, or quaternary ammonium polymers, which dissipate the electrical charge by providing a layer which conducts electrons by an ionic mechanism. However, such layers are not very suitable as antistatic layers because they lose effectiveness under conditions of low relative humidity, become sticky under conditions of high relative humidity, and lose their antistatic effect after passage through processing baths. Additionally, conductive polymer layers used as subbing layers tend to worsen the adhesion of the light-sensitive layers to the support base or may negatively affect photographic properties of silver halide emulsion layers of photographic elements.

U.S. Pat. No. 4,424,273 describes a subbing antistatic layer comprising gelatin, a gelatin hardener, a vinyl addition latex polymer and a low viscosity and highly sulfonated polyacetal obtained upon reaction of a low viscosity polyacetal alcohol and a sulfonated aldehyde, the relative quantities of said gelatin and vinyl addition latex polymer to the acetal compound providing good adhesion characteristics without any significant loss of antistatic properties. Nevertheless a problem with this antistatic layer is that antistatic properties are diminished, even completely lost, when a coating is applied thereto. Accordingly, while this type of antistatic layer solves the problems of static electricity charges during coating of the photographic elements, it does not provide permanent antistatic protection to the photographic element after its manufacture.

Cross-linked polymer layers are well known in the photographic art to insure bonding of photographic layers to the support and/or prevent building up of electrostatic charges. U.S. Pat. No. 3,615,552 discloses a bonding layer for photographic elements comprising mixed acetals of polyvinyl alcohol with aldehydes with water-solubilizing groups and aldehyde without water-solubilizing groups, a hydrophobic polymer binder comprising hydroxyl groups, and a cross-linking agent such as a copolymer of unsaturated acid anhydrides. U.S. Pat. No. 3,071,466 discloses a bonding layer comprising a mixed acetals of polyvinyl alcohol with aldehydes with water-solubilizing groups and aldehyde without water-solubilizing groups, a hydrophobic polymer binder comprising hydroxyl groups in such a ratio that the polyacetal is soluble in organic solvents but only swellable in water, a binder polymer containing hydroxyl groups and being soluble in organic solvents, and a cross-linking agent containing at least two 1,2-epoxide groups. U.S. Pat. No. 4,225,665 discloses an antistatic layer comprising a conductive polymer having carboxyl groups, a hydrophobic polymer containing carboxyl groups and a cross-linking agent being a polyfunctional aziridine. U.S. Pat. No. 4,459,352 discloses a conductive polymer layer comprising a hydrophilic binder, a cellulose ester and a hardening agent. U.S. Pat. Nos. 5,096,975 and 5,126,405 disclose cross-linked conductive polymer layers comprising a copolymer of a vinylbenzene sulfonic acid and an ethylenically unsaturated monomer containing hydroxyl groups, a binder polymer containing hydroxyl groups and a cross-linking agent being respectively a methoxyalkyl-melamine or a hydroxylized metal lower alkoxide.

However, attempts to prevent or reduce electrostatic charge build up by a conductive layer may have a limited success. In addition to reducing such build-up to a sufficient degree, such layers are required to assure adequate adhesion to hydrophobic supports and subsequently coated photographic layers, to provide permanent antistatic protection when overcoated with photographic layers or after photographic processing, and not to affect negatively the photographic performance of the element.

Accordingly, there is still the need to provide single layer antistatic layers, using conductive polymer layers, which provide photographic elements a permanent antistatic protection.

SUMMARY OF THE INVENTION

The present invention relates to a light-sensitive photographic element comprising a polymeric film base, at least one silver halide emulsion layer, and an antistatic layer comprising a low viscosity and highly sulfonated water soluble polyacetal (e.g., derived as the reaction product of a low viscosity polyvinyl alcohol and a sulfonated aldehyde), a hydrophobic binder selected from the group consisting of a water dispersible sulfopolyester and a latex polymer having hydrophilic functionality, and a polyfunctional aldehyde crosslinking agent. The antistatic layer may be present as a backing layer on the side of the base opposite the silver halide emulsion layer, as a subbing layer between the base and the emulsion layer in a single or double side coated photographic element, and/or as a subbing layer between the base and a different backing layer.

The antistatic layer of the present invention provides relatively permanent antistatic protection when a coating is applied thereto.

DETAILED DESCRIPTION OF THE INVENTION

The present invention relates to a light sensitive photographic element, especially a silver halide photographic element having a polymeric film base. The polymeric film base comprises a polymeric substrate such as a polyester, and especially such as polyethyleneterephthalate or polyethylenenaphthalenate. Other useful polymeric film bases include cellulose acetates, especially cellulose triacetate, polyolefins, polycarbonates and the like. The polymeric film base has an antistatic layer adhered to one or both major surfaces of the base. A primer layer or a subbing layer may be used between the base and the antistatic layer. It has been found, however, that the antistatic layer according to the present invention has generally good adhesion to the polymeric film base without the need of primer or subbing layers.

The antistatic layer of the present invention comprises a conductive polymer which is a low viscosity and highly sulfonated polyacetal which may for example be obtained upon reaction of a low viscosity polyvinyl alcohol and a sulfonated aldehyde, a hydrophobic binder selected from the group consisting of a water dispersible sulfopolyester and a latex polymer having hydrophilic functionality, and a polyfunctional aldehyde crosslinking agent.

The polyacetal compound for use in the present invention can be prepared according to known methods. The preparation is usually carried out in aqueous or methanol solution with the addition of mineral acids (e.g., sulfuric acid) as acetalization catalysts, preferably at temperatures between 50° C. and 80° C. The aldehyde sulfonic acids used to prepare the polymer acetals can be aliphatic or aromatic. Examples of aliphatic sulfonic acids are butyraldehyde sulfonic acid, acetaldehyde sulfonic acid and propionaldehyde sulfonic acid. The following are examples of suitable aromatic aldehyde sulfonic acids: benzaldehyde-2-sulfonic acid, benzaldehyde-4-sulfonic acid, benzaldehyde-2,4-disulfonic acid and substituted aldehyde sulfonic acids, such as 4-chloro-benzaldehyde-2-sulfonic acid, 5-nitro-benzaldehyde-2-sulfonic acid, 2,6-dichloro-benzaldehyde-3-sulfonic acid, and 3-methyl-benzaldehyde-2-sulfonic acid. Suitable polyvinyl alcohols are characterized by a low intrinsic viscosity, that is, lower than 1.5 dl/g, preferably between 0.4 and 1.2 dl/g and more preferably between 0.4 and 0.6 dl/g. The vinylacetate content of said polyvinyl alcohols is preferably less than 5 percent, and more preferably equal or less than 2 percent. The polyacetals for use in the present invention are highly sulfonated, i.e., they include sulfonated moieties in the quantity of at least 50 percent by weight (of the polyacetal), preferably between 50 and 85 percent by weight, more preferably between 60 and 75 percent by weight. In the present invention, the term "sulfonated moiety" includes the carrying portion of the polymer, that is the unit within the polymer which carries the sulfonated group. The polyacetals obtained upon acetalization with sulfonated aldehyde of said low viscosity polyvinyl alcohols are characterized by low intrinsic viscosities, i.e., lower than about 1.0 dl/g, preferably between 0.2 and 0.8 dl/g, more preferably between 0.35 and 0.7 dl/g when measured in $NaNO_3$ 1M at 30° C. According to experiments of the Applicant, it has been found that polyacetals having fewer sulfonated moieties than the preferred range do not decrease surface resistivity sufficiently so as to avoid the storage of electric charges in most circumstances and polyacetals having more sulfonated moieties than the preferred range cause the adhesion between the photographic layers and the support base to be inadequate to withstand some handling conditions to which photographic elements are subjected. Polyacetals having intrinsic viscosities exceeding the described range, particularly the upper limit in the range, cause significant loss of adhesion. On the contrary, polyacetals having lower intrinsic viscosity values in the preferred range, for example between 0.2 and 0.5 dl/g, ensured a better adhesion. Polyacetals suitable to the purpose of the present invention are described for example in U.S. Pat. No. 4,424,273.

Another component of the antistatic layer according to the present invention is a hydrophobic binder such as water dispersible sulfopolyester or a latex polymer having hydrophilic functionality.

A wide variety of known water dispersible sulfopolyesters can be used. They include a polyester comprising at least one unit containing a salt of a $—SO_3H$ group, preferably as an alkali metal or ammonium salt. In some instances, these sulfopolyesters are dispersed in water with an emulsifying agent and high shear to yield a stable emulsion. Additionally, stable dispersions may be produced in instances where sulfopolyesters are initially dissolved in a mixture of water and an organic cosolvent, with subsequent removal of cosolvent yielding an aqueous sulfopolyester dispersion.

Sulfopolyesters disclosed in U.S. Pat. Nos. 3,734,874, 3,779,993, 4,052,368, 4,104,262, 4,304,901, 4,330,588, for example, relate to low melting (below 100° C.) or noncrystalline sulfopolyester which may be dispersed in water according to methods mentioned above. In general, sulfopolyesters of this type may be best described as polymers containing units (all or some of the units in a copolymer) of the following formula:

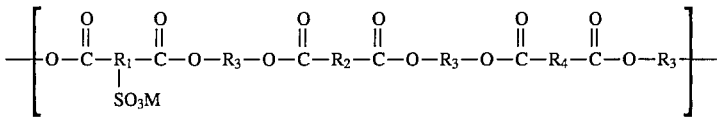

where

M can be an alkali metal cation such as sodium, potassium, or lithium; or suitable tertiary, and quaternary ammonium cations having 0 to 18 carbon atoms, such as ammonium, hydrazonium, N-methyl pyridinium, methylammonium, butylammonium, diethylammonium, triethylammonium, tetraethylammonium, and benzyltrimethylammonium.

$R_1$ can be an arylene group or aliphatic group incorporated in the sulfopolyester by selection of suitable sulfo-substituted dicarboxylic acids such as sulfoalkanedicarboxylic acids including sulfosuccinic acid, 2-sulfoglutaric acid, 3-sulfoglutaric acid, and 2-sulfododecanoic acid; and sulfoarenedicarboxylic acids such as 5'-sulfoisophthalic acid, 2-sulfoterephthalic acid, 5-sulfonaphthalene-1,4 -dicarboxylic acid; sulfobenzylmalonic acid esters such as those described in U.S. Pat. No. 3,821,281; sulfophenoxymalonate such as described in U.S. Pat. No. 3,624,034; and sulfofluorenedicarboxylic acids such as 9,9-di-(2'-carboxyethyl)-fluorene-2-sulfonic acid. It is to be understood that the corresponding lower alkyl carboxylic esters of 4 to 12 carbon atoms, halides, anhydrides, and sulfo salts of the above sulfonic acids can also be used.

$R_2$ can be optionally incorporated in the sulfopolyester by the selection of one or more suitable arylenedicarboxylic acids, or corresponding acid chlorides, anhydrides, or lower alkyl carboxylic esters of 4 to 12 carbon atoms. Suitable acids include the phthalic acids (orthophthalic, terephthalic, isophthalic), 5-t-butyl isophthalic acid, naphthalic acids (e.g., 1,4- or 2,5-naphthalene dicarboxylic), diphenic acid, oxydibenzoic acid, anthracene dicarboxylic acids, and the like. Examples of suitable esters or anhydrides include dimethyl isophthalate or dibutyl terephthalate, and phthalic anhydride.

$R_3$ can be incorporated in the sulfopolyester by the selection of one or more suitable diols including straight or branched chain alkylenediols having the formula $HO(CH_2)_nOH$ in which n is an integer of 2 to 12 and oxaalkylenediols having the formula $H—(OR_5)_m—OH$ in which $R_5$ is an alkylene group having 2 to 4 carbon atoms and m is an integer of 1 to 6, the values being such that there are no more than 10 carbon atoms in the oxaalkylenediol. Examples of suitable diols include ethyleneglycol, propyleneglycol, 1,5-pentanediol, 1,6-hexanediol, 1,8-octanediol, 1,10-decanediol, 2,2-dimethyl-1,3-propanediol, 2,2-diethyl-1,3-propanediol, 3-methyl-1,5-pentanediol, diethyleneglycol, dipropyleneglycol, diisopropyl-eneglycol, and the like. Also included are suitable cycloaliphatic diols such as 1,4-cyclohexanedimethanol, 1,3-cyclohexanedimethanol, and the like. Suitable polyester or polyether polyols may be used such as polycaprolactone, polyneopentyl adipate, or polyethyleneoxide diols up to 4000 in molecular weight, and the like. Generally these polyols are used in conjunction with lower molecular weight diols such as ethylene glycol if high molecular weight polyesters are desired.

$R_4$ can be incorporated in the sulfopolyester by the selection of suitable aliphatic or cycloaliphatic dicarboxylic acids or corresponding acid chlorides, anhydrides or ester derivatives; such as acids having the formula $HOOC(CH_2)_oCOOH$, wherein o is an integer having an average value of 2 to 8 (e.g., succinic acid, adipic acid, maleic acid, glutaric acid, suberic acid, sebacic acid, and the like). Suitable cycloaliphatic acids include cyclo-hexane-1, 4-di-carboxylic acid, and the like.

The sulfopolyesters used in the present invention can be prepared by standard techniques, typically involving the reaction of dicarboxylic acids (or diesters, anhydrides, etc. thereof) with monoalkylene glycols and/or polyols in the presence of acid or metal catalysts (e.g., antimony trioxide, zinc acetate, p-toluene sulfonic acid, etc.), utilizing heat and pressure as desired. Normally, an excess of the glycol is supplied and removed by conventional techniques in the later stages of polymerization. When desired, a hindered phenol antioxidant may be added to the reaction mixture to protect the polyester from oxidation. To ensure that the ultimate polymer will contain more than 90 mole % of the residue of monoalkylene glycols and/or polyols, a small amount of a buffering agent (e.g., sodium acetate, potassium acetate, etc.) is added. While the exact reaction mechanism is not known with certainty, it is thought that the sulfonated aromatic dicarboxylic acid promotes the undesired polymerization of the glycol per se and that this side reaction is inhibited by a buffering agent.

Other binders usable in the antistatic layer according to the present invention include latex polymers having hydrophilic functionality as described e.g. in U.S. Pat. Nos. 4,689,359 and 5,006,451. Suitable latex polymers for use as binders according to the present invention include copolymers of (1) one or more polymerizable monomers selected from the group consisting of styrene, vinylidene chloride, acrylonitrile, alkyl acrylates and alkyl methacrylates with (2) one or more substituted polymerizable monomers selected from the group consisting of styrene, alkyl acrylates and alkyl methacrylates that have been substituted with a hydrophilic functional group such as an aminoalkyl salt group, an hydroxyalkyl group or a carboxylic acid group.

Examples of group (1) comonomers include: ethyl acrylate, ethyl methacrylate, butyl acrylate and butyl methacrylate.

Examples of group (2) comonomers include: 2-aminoethyl methacrylate hydrochloride, 2-hydroxyethyl acrylate, 2-hydroxyethyl methacrylate, N-(3-aminopropyl)methacrylate hydrochloride, p-aminostyrene hydrochloride, acrylic acid, methacrylic acid, itaconic acid and mono methyl ester of itaconic acid.

Preferred latex polymers for the purposes of the present invention are vinylidene chloride-containing polymers having carboxyl functional groups, such as copolymers of vinylidene chloride and an unsaturated carboxylic acid such as acrylic or methacrylic acid, copolymers of vinylidene chloride and a half ester of an unsaturated carboxylic acid such as the mono methyl ester of itaconic acid, terpolymers of vinylidene chloride, itaconic acid and an alkyl acrylate such as ethyl acrylate or methyl methacrylate, and terpolymers of vinylidene chloride, acrylonitrile or methacrylonitrile and an unsaturated carboxylic acid such as acrylic or methacrylic acid.

Especially preferred latex polymers are terpolymers of vinylidene chloride/methyl (meth)acrylate/itaconic acid containing 35 to 95 weight percent vinylidene chloride, 3.5 to 64.5 weight percent methyl (meth)acrylate and 0.5 to 25 weight percent itaconic acid, e.g. as described in U.S. Pat. Nos. 2,627,088 and 2,779,684.

The latex polymers useful in the present invention are obtained upon emulsion polymerization of suitable monomers. The obtained polymers are present in the latex dispersed in the form of very small particles having dimensions ranging from 0.03 to 0.4 μm, more preferably ranging from 0.04 to 0.1 μm. Such water dispersions (latexes) are usually prepared by dispersing the monomers in water in the presence of one or more anionic dispersing or surfactant agents of the type used in photography (such as for instance dioctylsodiumsulfosuccinate, sodium laurylsulfate, sodium alkylnaphthalenesulfonate, and other described in Schwarty et al., *Surface Active Agents and Detergents*, vol. I and II, Interscience Publishers and in U.S. Pat. Nos. 2,922,108, 3,068,101, 3,201,252, 3,165,409, in FR 1,566,240 and 1,497,930 and in GB 580,504 and 985,483) or, in particular cases when it is necessary, cationic or nonionic dispersing agents (of the type described in GB 1,274,523 and in U.S. Pat. Nos. 3,726,025 and 3,860,425), and performing polymerization by employing a water-soluble initiator which is generally a per-compound (ammonium or potassium persulfate, hydrogen peroxyde, sodium perborate, etc.), or a redox system (such as persulfate-bisulfite), or a compound of the α,α'-azobisisobutyr-amidine type and 4,4'-azobiscyanopentanoic acid type (as described in U.S. Pat. Nos. 2,739,137, 2,599,900 and in GB 759,409).

The coated conductive layers provided onto the support bases according to the present invention must be rendered water-insoluble as photographic elements including such conductive layers are exposed either to the photographic baths at high temperature for a long time or to high mechanical stressing. This can be done by including a suitable crosslinking agent in the aqueous coating composition of the conductive subbing layer or by incorporating a suitable diffusing hardening agent, which is capable of rendering the conductive layer water-insoluble, in any appropriate place in the composite photographic element. For example, a diffusible crosslinking agent can be incorporated in a hydrophilic layer coated in association with the coated conductive layer. "In association with" means in the present invention a contiguous layer through which the diffusible crosslinking agent can diffuse to reach the conductive layer. In a preferred embodiment of this invention, the crosslinking agent is included in the aqueous coating composition with the sulfonated polymer and the binder. Organic compounds having at least two aldehyde groups in their molecule are suitable as crosslinking agents. Preferred crosslinking agents for use in this invention include aliphatic dialdehydes in which the aldehyde groups are separated by a linear or branched carbon atom chain, preferably a chain of 2 or 3 carbon atoms, which carbon atom chain may be interrupted by the insertion of a divalent linking group such an oxygen atom. Suitable crosslinking agents are for instance: glutaraldehyde, beta-methylglutaraldehyde, glyoxal, maleic dialdehyde, succinic dialdehyde, methyl succinic dialdehyde, alpha-n-butoxy glutaraldehyde, butyl maleic dialdehyde and oxy-bis-acetaldehyde. It is preferred that oxy-bis-acetaldehyde be employed.

The quantity of crosslinking agent is not per se critical and will vary according to the proportions of the ingredients of the conductive composition, but should be sufficient to render water-insoluble the subbing layer. Quantities of the crosslinking agent in the range of 1 to 30 percent, preferably 2 to 10 percent by weight with respect to the weight of the whole conductive layer ingredients are generally useful according to the present invention. Such crosslinking agents are preferably employed at acid pH coating values since they favour hardening of the hydroxyl group-containing polyacetal. In order to cause a rapid hardening, it is advisable for the conductive layer which is to be hardened to be treated, after coating a drying, for a few minutes at temperatures of 50° C. to 120° C. Preferably, a temperature from about 60° C. to 100° C. for approximately 1 to 10 minutes is employed.

The coating composition for preparing the antistatic layer according to this invention can be prepared either by dispersing the sulfopolyester in water, optionally with water-miscible solvent (generally less than 50 weight percent cosolvent), or by providing the polymer latex in water. The sulfopolyester dispersion or the polymer latex can contain more than zero and up to 50 percent by weight sulfopolyester or polymer, preferably in the range of 10 to 25 weight percent sulfopolyester or polymer. Organic solvents miscible with water can be added to the sulfopolyester dispersion. Examples of such organic solvents that can be used include acetone, methyl ethyl ketone, methanol, ethanol, and other alcohols and ketones. The presence of such solvents is desirable when need exists to alter the coating characteristics of the coating solution.

The sulfopolyester dispersion or the polymer latex and the aqueous polyacetal solution are mixed together. Generally, this involves stirring the aqueous solutions and dispersions together for sufficient time to effect complete mixing. If other materials or particles are to be incorporated into the coating mixture, however, it is frequently more convenient to stir the mixture for several hours by placing the mixture into a glass jar containing several glass beads and roll milling it. Surfactants can be added at the mixing step. Any water compatible surfactant, except those of high acidity or basicity or complexing ability, or which otherwise would interfere with the desired element, is suitable for the practice of this invention. A suitable surfactant does not alter the antistatic characteristics of the coating, but allows for the uniform wetting of a substrate surface by the coating solution. Depending upon the substrate, wetting out completely can be difficult, so it is sometimes convenient to alter the coating composition by the addition of organic solvents. It is apparent to those skilled in the art that the addition of various solvents is acceptable, as long as it does not cause flocculation or precipitation of the sulfopolyester, the polymer or the polyacetal.

The sulfopolyester or polymer latex/polyacetal coating compositions can contain any percent by weight solids. For ease of coatability, these compositions preferably comprise more than zero (as little as about 0.05 weight percent, preferably as little as 0.15 weight percent, solids can be useful) and up to about 15 percent by weight solids. More preferably, the compositions comprise more than zero and up to 10 weight percent solids, and most preferably more than zero and up to 6 weight percent solids. In the dried solids the weight ratio of polyacetal to sulfopolyester or polymer latex may vary from 1:0.1 to 1:5, preferably from 1:0.5 to 1:3. Higher values of polyacetal/sulfopolyester or polymer latex weight ratios give better antistatic performance but lower adhesion of the photographic layers. Lower values of polyacetal/sulfopolyester or polymer latex weight ratios give poor antistatic performance but better adhesion of the photographic layers.

These aqueous coating compositions can be coated by any convenient method including, but not limited to, dip coating, spin coatings, or roll coating. Coatings can also be formed by spray coating, although this is less preferred.

Once the composition is coated out, the coated film can be dried, generally at a temperature from room temperature up to a temperature limited by the properties of the film base and sulfopolyester, preferably room temperature to 200° C., most preferably 50° to 150° C., for a few minutes. It is preferred that the dried conductive layer has a thickness in the range of 0.1 to 5.0 micrometers, most preferably in the range of 0.2 to 0.5 micrometers for optimum adhesion of the photographic layers and antistatic properties, such a thickness being accomplished by well known appropriate modifications to the concentration of the conductive composition and/or the coating conditions.

The antistatic layer of the present invention may contain other addenda which do not influence the antistatic properties of the layer, such as, for example, matting agents, plasticizers, lubricants, dyes, and haze reducing agents.

Polymeric film bases for the practice of this invention include polyesters such as polyethyleneterephthalate (PET) or polyethylenenaphthalenate (PEN), copolyesters, polyamide, polyimide, polyepoxydes, polycarbonate, polyolefins such as polyvinyl chloride, polyvinylidene chloride, polystyrene, polypropylene, polyethylene, or polyvinylacetate, poly-acrylates such as polymethylmethacrylate, and cellulose esters such as cellulose triacetate.

The photographic elements useful in this invention may be any of the well-known silver halide photographic elements for imaging in the field of graphic arts, printing, color, medical and information systems.

Typical imaging element constructions of the present invention comprise:

1. The film base with an antistatic layer on one surface and the photographic silver halide emulsion layer or layers on the other surface of the film base. In this construction an auxiliary layer may or may not be present over the antistatic layer. Examples of auxiliary layers include backing antiscratching or slip layers and back side gelatin antihalation layers.
2. The film base with an antistatic layer on one surface and at least one silver halide emulsion layer adhered to the same surface as the antistatic layer, over the antistatic layer.
3. The film base with antistatic layers on both surfaces of the polymeric film base and at least one photographic silver halide emulsion layer on one or both sides of the film base, over said antistatic layers.

The silver halides employed in this invention may be any one for use in silver halide photographic emulsions, such as silver chloride, silver bromide, silver iodide, silver chlorobromide, silver chloroiodide, silver iodobromide and silver chloroiodobromide.

The grains of these silver halides may be coarse or fine, and the grain size distribution of them may be narrow or extensive. Further, the silver halide grains may be regular grains having a regular crystal structure such as cube, octahedron, and tetradecahedron, or the spherical or irregular crystal structure, or those having crystal defects such as twin planes, or those having a tabular form, or combination thereof. Furthermore, the grain structure of the silver halides may be uniform from the interior to exterior thereof, or be multilayer. According to a simple embodiment, the grains may comprise a core and a shell, which may have different halide compositions and/or may have undergone different modifications such as the addition of dopants. Besides having a differently composed core and shell, the silver halide grains may also comprise different phases inbetween. Furthermore, the silver halides may be of such a type as allows a latent image to be formed mainly on the surface thereof or such a type as allows it to be formed inside the grains thereof. Both negative and positive acting emulsions are useful on the film base of the present invention.

The silver halide emulsions which can be utilized in this invention may be prepared according to different methods as described in, for example, *The Theory of the Photographic Process*, C. E. K. Mees and T. H. James, Macmillan (1966), *Chimie et Physique Photographique*, P. Glafkides, Paul Montel (1967), *Photographic Emulsion Chemistry*, G. F. Duffin, The Focal Press (1966), *Making and Coating Photographic Emulsion*, V. L. Zelikman, The Focal Press (1966), in U.S. Pat. No. 2,592,250 or in GB Pat. No. 635,841.

The emulsions can be desalted to remove soluble salts in the usual ways, e.g., by dialysis, by flocculation and redispersing, or by ultrafiltration, but emulsions still having soluble salts are also acceptable.

As the binder of protective colloid for use in the photographic element, gelatin is advantageously used, but other hydrophilic colloids may be used such as gelatin derivatives, colloidal albumin, gum arabic, colloidal hydrated silica, cellulose ester derivatives such as alkyl esters of carboxylated cellulose, hydroxy ethyl cellulose, carboxy methyl cellulose, synthetic resins, such as the amphoteric copolymers described in U.S. Pat. No. 2,949,442, polyvinyl alcohol, and others well known in the art. These binders may be used in admixture with dispersed (latex-type) vinyl polymers, such as those disclosed, for example, in U.S. Pat. Nos. 3,142,568, 3,193,386, 3,062,674, 3,220,844.

The silver halide emulsions can be sensitized with a chemical sensitizer as known in the art such as, for example, a noble metal sensitizer, a sulfur sensitizer, a selenium sensitizer and a reduction sensitizer.

The silver halide emulsions can be spectrally sensitized (ortho-, pan- or infrared-sensitized) with methine dyes such as those described in *The Cyanine Dyes and Related Compounds*, F. H. Hamer, John Wiley & Sons (1964). Dyes that can be used for the purpose of spectral sensitization include cyanine dyes, merocyanine dyes, complex cyanine dyes, complex merocyanine dyes, homopolar cyanine dyes, hemicyanine dyes, styryl dyes and hemioxonol dyes. Particularly useful dyes are those belonging to the class of cyanine dyes, merocyanine dyes and complex merocyanine dyes. Other dyes, which per se do not have any spectral sensitization activity, or certain other compounds, which do not substantially absorb visible radiation, can have a supersensitization effect when they are used in combination with said spectral sensitizing dyes. Among suitable sensitizers known in the art, heterocyclic mercapto compounds containing at least one electronegative substituent, nitrogen-containing heterocyclic ring-substituted aminostilbene compounds, aromatic organic acid/formaldehyde condensation prod-ucts, cadmium salts and azaindene compounds are particularly useful.

The silver halide photographic elements according to the present invention may comprise compounds preventing the formation of fog or stabilizing the photographic characteristics during the production or storage of photographic elements or during the photographic treatment thereof, such as heterocyclic nitrogen-containing compounds, arylthiosulfinic acids and arylthiosulfonic acids.

The photographic elements according to this invention may comprise other additives such as desensitizers, brightening agents, couplers, hardening agents, coating agents, plasticizers, lubricants, matting agents, high-boiling organic solvents, development accelerating compounds, UV absorbers, antistatic agents, antistain agents, and the like as described, for example, in Research Disclosure Vol. 176, No. 17643, December 1979.

The photographic elements according to this invention can be used for any of general black and white photography, graphic arts, X-ray, print, microfilm, electron-ray record, infrared-ray record, color photography and the like.

Useful photographic elements according to this invention are silver chloride emulsion elements as conventionally employed in forming halftone, dot, and line images usually called "lith" elements. Said elements contain silver halide emulsions comprising preferably at least 50 mole % of silver chloride, more preferably at least 80 mole % of silver chloride, the balance, if any, being silver bromide. If desired, said silver halides can contain a small amount of silver iodide, in an amount that is usually less than about 5 mole %, preferably less than 1 mole %. The average grain size of silver halide used in lith emulsions is lower than about 0.7 micrometers, preferably lower than about 0.4 micrometers, more preferably lower than 0.2 micrometers. The lith elements can include a hydrazine compound to obtain high contrast images. Any known hydrazine compounds can be used, such as, for example, hydrazine compounds described in Research Disclosure 235, Item 23510, November 1983, *Development Nucleation by Hydrazine and Hydrazine*

*Derivatives*. Other references to lith materials can be found in the same Research Disclosure.

Color photographic elements for use in the present invention comprise silver halide emulsion layers selectively sensitive to different portions of the visible and/or infrared spectrum and associated with yellow, magenta and cyan dye forming couplers which form (upon reaction with an oxidized primary amine type color developing agent) respectively yellow, magenta and cyan dye images. As yellow couplers, open chain ketomethylene compounds can be used, such as benzoylacetoanilide type yellow couplers and pyvaloylacetoanilide type yellow couplers. Two-equivalent type yellow couplers, in which a substituent capable of separating off at the time of coupling reaction attached to the carbon atom of the coupling position, can be used advantageously. As magenta couplers, pyrazolone type, pyrazolotriazole type, pyrazolinobenzimidazole type and indazolone type magenta couplers can be used. As cyan couplers, phenols and naphthols type cyan couplers can be used. Colored magenta couplers and colored cyan couplers can also be used advantageously, in addition to the above-mentioned couplers. For the purpose of improving sharpness and graininess of the image, the light-sensitive color materials used in this invention may additionally contain development inhibitor-releasing couplers or compounds.

Silver halide photographic elements for X-ray exposure to be used in the present invention comprise a transparent film base, such as a polyethyleneterephthalate film base, having on at least one of its sides, preferably on both of its sides, a silver halide emulsion layer. The silver halide emulsions coated on the sides may be the same or different and comprise silver halide emulsions commonly used in photographic elements, among which the silver bromide or silver bromoiodide emulsions being particularly useful for X-ray elements. The silver halide grains may have different shapes, for instance cubic, octahedral, spherical, tabular shapes, and may have epitaxial growth; they generally have mean grain sizes ranging from 0.2 to 3 micrometers, more preferably from 0.4 to 1.5 micrometers. Particularly useful in X-ray elements are high aspect ratio or intermediate aspect ratio tabular silver halide grains, as disclosed for example in U.S. Pat. Nos. 4,425,425 and 4,425,426, having an aspect ratio, that is the ratio of diameter to thickness, of greater that 5:1, preferably greater than 8:1. The silver halide emulsions are coated on the film base at a total silver coverage comprising in the range from about 2.5 to about 6 grams per square meter. Usually, the light-sensitive silver halide elements for X-ray recording are associated during X-ray exposure with intensifying screens as to be exposed to radiation emitted by said screens. The screens are made of relatively thick phosphor layers which transform X-rays into light radiation (e.g., visible light or infrared radiation). The screens absorb a portion of X-rays much larger than the light-sensitive element and are used to reduce radiation dose necessary to obtain a useful image. According to their chemical composition, the phosphors can emit radiation in the blue, green, red or infrared region of the electromagnetic spectrum and the silver halide emulsions are sensitized to the wavelength region of the radiation emitted by the screens. Sensitization is performed by using spectral sensitizing dyes as known in the art. Particularly useful phosphors are the rare earth oxysulfides doped to control the wavelength of the emitted light and their own efficiency. Preferably are lanthanum, gadolinium and lutetium oxysulfides doped with trivalent terbium as described in U.S. Pat. No. 3,752,704. Among these phosphors, the preferred ones are gadolinum oxysulfides wherein from about 0.005% to about 8% by weight of the gadolinium ions are substituted with trivalent terbium ions, which upon excitation by UV radiation, X-rays, cathodic rays emit in the blue-green region of the spectrum with a main emission line at about 544 nm. The silver halide emulsions are spectrally sensitized to the spectral region of the light emitted by the screens, preferably to a spectral region of an interval comprised within 25 nm from the wavelength maximum emission of the screen, more preferably within 15 nm, and most preferably within 10 nm.

The light-sensitive silver halide photographic elements according to this invention can be processed after exposure to form a visible image according to processes which are generally employed for the light-sensitive elements for general black and white photography, X-ray, microfilm, lith film, print or color photography. In particular, the basic treatments steps of black and white photography include development with a black and white developing solution and fixation, and the basic treatment steps of color photography include color development, bleach and fixation. Processing formulations and techniques are described, for example, in *Photographic Processing Chemistry*, L. F. Mason, Focal Press (1966), *Processing Chemicals and Formulas*, Publication J-1, Eastman Kodak Company (1973), *Photo-Lab Index*, Morgan and Morgan, Dobbs Ferry (1977), *Neblette's Handbook of Photography and Reprography—Materials, Processes and Systems*, VanNostrand Reinhold, 7th Ed. (1977), and *Research Disclosure*, Item 17643 (December 1978).

Objects and advantages of this invention are further illustrated by the following examples, but the particular materials and amounts thereof recited in these examples, as well as other conditions and details, should not be construed to unduly limit this invention.

In the Examples below, all percents are by weight unless otherwise indicated.

I. PREPARATION OF SULFONATED POLYACETAL 985 g of polyvinyl alcohol (98% hydrolysis and $[\eta]=0.58$ dl/g in $H_2O$ at 25° C.) dissolved in 7 liters of water were added with 1570 g of benzaldehyde-2,4-disulfonic acid sodium salt and 51 ml of 98%$H_2SO_4$; the solution was then heated at 70° C. for 2 hours. After cooling, the polymer was separated by pouring the obtained solution into ethanol under stirring; then it was washed with ethanol and dried. The yield was 2300 g of a water soluble polymer having % S=12.15 corresponding to a content of 72% w/w of vinylbenzal-2,4-disulfonic acid sodium salt moieties. The viscosity was $[\eta]=0.7$ dl/g in $NaNO_3$ 1M at 30° C.

II. PREPARATION OF SULFOPOLYESTER

Synthesis of Sulfopolyester (Polymer A)

A one gallon polyester kettle was charged with 126 g (6.2 mole %) dimethyl 5-sodiumsulfoisophthalate, 625.5 g (46.8 mole %) dimethyl terephthalate, 628.3 g (47.0 mole %) dimethyl isophthalate, 854.4 g (200 mole % glycol excess) ethylene glycol, 365.2 g (10 mole %, 22 weight % in final polyester) PCP-0200™ polycaprolactone diol (Union Carbide, Danbury, Conn.), 0.7 g antimony oxide, and 2.5 g sodium acetate. The mixture was heated with stirring to 180° C. at 138 kPa (20 psi) under nitrogen, at which time 0.7 g of zinc acetate was added. Methanol evolution was observed. The temperature was increased to 220° C. and held for 1 hour. The pressure was then reduced, vacuum applied (0.2 torr), and the temperature increased to 260° C.

The viscosity of the material increased over a period of 30 minutes, after which time a high molecular weight, clear, viscous sulfopolyester was drained. This sulfopolyester was found by DSC to have a $T_g$ of 41.9° C. The theoretical sulfonate equivalent weight was 3954 g polymer per mole of sulfonate. 500 g of the polymer were dissolved in a mixture of 2000 g water and 450 g isopropanol at 80° C. The temperature was then raised to 95° C. in order to remove the isopropanol (and a portion of water), yielding a 21% solids aqueous dispersion.

Synthesis of Sulfopolyester (Polymer B)

A one gallon polyester kettle was charged with 111.9 g (5.5 mole %) 5-sodiumsulfoisophthalic acid, 592.1 g (47.0 mole %) terephthalic acid, 598.4 g (47.5 mole %) isophthalic acid, 705.8 g ethylene glycol, 59.9 g neopentyl glycol, 0.7 g antimony oxide, and 2.5 g sodium acetate. The mixture was heated with stirring to 230° C. at 345 kPa (50 psi) under nitrogen for 2 hours, during which time water evolution was observed. The temperature was increased to 250° C. and pressure was reduced, vacuum applied (0.2 torr), and the temperature increased to 270° C. The viscosity of the material increased over a period of 45 minutes, after which time a high molecular weight, clear, viscous sulfopolyester was drained. This sulfopolyester was found by DSC to have a $T_g$ of 70.3° C. The theoretical sulfonate equivalent weight was 3847 g polymer per mole of sulfonate. 500 g of the polymer were dissolved in a mixture of 2000 g water and 450 g isopropanol at 80° C. The temperature was then raised to 95° C. in order to remove the isopropanol (and a portion of water), yielding a 22% solids aqueous dispersion.

III. PREPARATION OF COATING MIXTURES

General Procedure

The polyacetal was dissolved in water and diluted to desired concentration by mixing with water. This solution was mixed with an aqueous dispersion of the sulfopolyester or the polymer latex and a water solution of the hardening agent. A small amount of a surfactant can be added to improve the wetting properties of the coating. The mixture was coated with double roller coating onto a film substrate such as polyethyleneterephthalate or cellulose triacetate in order to perform static decay and surface resistivity measurements. It was found possible to coat the antistatic composition onto the film substrate as such without employing film treatments (e.g., flame treatment, corona treatment, plasma treatment) or additional layers (e.g., primers, subbings).

The coated article was dried at 60° C. for 2 minutes. The antistatic properties of the coated film were measured by determining the surface resistivity of each coated sample. Surface resistivity measurements were made using the following procedure: samples of each film were kept in a cell at 21° C. and 25% R.H. for 24 hours and the electrical resistivity was measured by means of a Hewlett-Packard High Resistance Meter model 4329A. Values of resistivity of less than $5\times10^{11}$ are optimum. Values up to $1\times10^{12}$ can be useful. The following examples also report four adhesion values: the first is the dry adhesion value and refers to the adhesion of the silver halide emulsion layers and of the auxiliary gelatin layers to the antistatic layer prior to the photographic processing; the second and the third adhesion values are the wet adhesion values and refer to the adhesion of the above layers to the antistatic layer during the photographic processing (developer and fixer); the fourth adhesion value is the dry adhesion value and refers to the adhesion of the above layers to the antistatic layer after photographic processing. In particular, the dry adhesion was measured by tearing samples of the coated film, applying a 3M Scotch™ 5959 Pressure Sensitive Tape along the tear line of the film and separating rapidly the tape from the film: the layer adhesion was evaluated according a scholastic method giving a value 0 when the whole layer was removed from the base and a value of 10 when no part thereof was removed from the base and intermediate values for intermediate situations. The wet adhesion was measured by drawing some lines with a pencil point to form an asterisk on the film just taken out from the processing bath and by rubbing on the lines with a finger. Also in this case, the adhesion of the layers was measured according a scholastic method by giving a value of 0 when the layers were totally removed from the base, a value of 10 when no portion thereof was removed and intermediate values for intermediate cases.

EXAMPLE 1

The following subbing compositions were prepared and coated onto a polyethylene terephthalate film base previously coated on both sides with an adhesion promoting coating (primer layer) of a poly(vinylidene chloride-itaconic acid-ethylacrylate) latex containing 89 mole % of vinylidene chloride, 2 mole % of itaconic acid and 9 mole % of ethylacrylate. In each coating, the subbing composition at pH 2.5–3.0 was applied to the base by the double roller coating technique and dried at 60° C. for 2 minutes to obtain a dry thickness of 0.25 micrometers. The amounts of the components reported in Table 1 are expressed in grams, the percentages are by weight and water is the solvent or dispersing agent.

TABLE 1

| | Coatings | | | | | | |
|---|---|---|---|---|---|---|---|
| Composition | 1 | 2 | 3 | 4 | 5 | 6 | 7 |
| Sulfonated Polyacetal (30%) | 21.3 | 33.0 | 16.0 | 25.0 | 33.0 | 41.6 | 33.0 |
| Gelatin | 0.8 | — | — | — | — | — | — |
| PEA Latex (20%) | 0.6 | — | — | — | — | — | — |
| Dimethylurea (2%) | 6.4 | — | — | — | — | — | — |
| Resorcyl Aldehyde (2%) | 3.2 | — | — | — | — | — | — |
| Polymer A (20%) | — | — | 75.0 | 62.5 | 50.0 | 37.5 | 50.0 |
| Glyoxal (40%) | — | — | — | — | — | — | 1.25 |
| Oxybisacetaldehyde (50%) | — | 0.3 | 0.15 | 0.22 | 0.3 | 0.37 | — |
| Water | 967 | 967 | 909 | 913 | 917 | 921 | 915 |

The surface electrical resistivity and the dry adhesion between the subbing layer and the primer layer were measured by the procedures described above. The results obtained are reported in Table 2 below.

TABLE 2

| | Coatings | | | | | | | |
|---|---|---|---|---|---|---|---|---|
| | 1 | 2 | 3 | 4 | 5 | 6 | 7 | 8 |
| Surface Resistivity (Ohms/sq) | $1 \times 10^{11}$ | $5 \times 10^{9}$ | $2 \times 10^{12}$ | $7 \times 10^{11}$ | $2 \times 10^{10}$ | $1 \times 10^{10}$ | $3 \times 10$ | $7 \times 10^{14}$ |
| Dry Adhesion | 10 | 2 | 10 | 10 | 10 | 10 | 10 | 10 |

The data of Table 2 show that the antistatic layers of the present invention (coatings 3 to 7), comprising a sulfonated polyacetal, a sulfopolyester binder and a bis-aldehyde hardening agent, provide excellent antistatic properties and good adhesion to the primer layer, as coating 1 prepared according to U.S. Pat. No. 4,424,273. A conventional gelatin subbing (coating 8) was used as a reference for trial evaluations. Coating 2 comprising the sulfonated polyacetal and the bis-aldehyde hardening agent but no sulfopolyester binder, despite of excellent antistatic properties, did not provide adhesion to the primer layer.

EXAMPLE 2

The antistatic coatings 1, 4, 5 and 6 of Example 1 were each overcoated with a conventional gelatin antihalation layer containing antihalation dyes, a surfactant and a hardener and with a gelatin protective layer containing a matting agent, a surfactant and a hardener (Coatings 9, 10, 11 and 12, respectively). The two layers were coated at a total gelatin coverage of 4.5 g/m$^2$ and a total thickness of 4.5 micrometers. The surface electrical resistivity of the coatings and the adhesion of the antihalation layer before processing and after processing in 3M RDC5 Developer are shown in Table 3.

TABLE 3

| | Coatings | | | |
|---|---|---|---|---|
| | 9 | 10 | 11 | 12 |
| Surface Resistivity (Ohm/sq): | | | | |
| before processing | $2 \times 10^{13}$ | $1 \times 10^{12}$ | $5 \times 10^{10}$ | $4 \times 10^{10}$ |
| after processing | $3 \times 13^{13}$ | $8 \times 10^{12}$ | $1 \times 10^{11}$ | $3 \times 10^{11}$ |
| Adhesion: | | | | |
| before processing | 6 | 10 | 10 | 10 |
| after processing | 6 | 10 | 10 | 10 |

The data of Table 3 show that the antistatic layer according to the present invention overcoated with the antihalation and protective gelatin layers (coatings 10 to 12) still retain good antistatic properties compared with coating 9 prepared according to prior art. In some cases (coatings 11 and 12), good antistatic properties are retained even after processing. Also, good dry and wet adhesion is provided.

EXAMPLE 3

The subbing coatings 1, 5 and 6 of Example 1 were each overcoated with a light-sensitive emulsion layer comprising a gelatin silver bromide emulsion chemically sensitized with gold and sulfur and optically sensitized to green light with a cyanine dye. The emulsion was coated at a silver coverage of 2 g/m$^2$ and a gelatin coverage of 1.6 g/m$^2$. A gelatin protective layer containing gelatin and a hardener was coated onto each emulsion layer at a gelatin coverage of 1.1 g/m$^2$. (coatings 13, 14 and 15, respectively). The following Table 4 reports the results of surface electrical resistivity, adhesion of the emulsion layer to the antistatic layer before processing, after processing in 3M XP515 Developer, after processing in 3M XP515 Fixer and after processing, and fog of the sensitive layer (D-min).

TABLE 4

| | Coatings | | |
|---|---|---|---|
| | 13 | 14 | 15 |
| Surface Resistivity (Ohm/sq): | $2 \times 10^{13}$ | $2 \times 10^{10}$ | $1 \times 10^{10}$ |
| Adhesion: | | | |
| before processing | 10 | 10 | 10 |
| in 3M XP515 Developer | 10 | 10 | 4 |
| in 3M XP515 Fixer | 10 | 10 | 2 |
| after processing | 10 | 10 | 10 |
| D-min after: | | | |
| 3 days at 38° C. | 0.21 | 0.21 | 0.21 |
| 5 days at 50° C. | 0.21 | 0.215 | 0.21 |
| 160 minutes at 70° C. | 0.22 | 0.21 | 0.21 |
| 160 minutes at 90° C. | 0.285 | 0.27 | 0.27 |

EXAMPLE 4

The following antistatic compositions of Table 5 were prepared and coated as described in Example 1.

TABLE 5

| | Coatings | | | | |
|---|---|---|---|---|---|
| Composition | 16 | 17 | 18 | 19 | 20 |
| Sulfonated Polyacetal (30%) | 21.3 | 33.0 | 33.0 | 33.0 | 33.0 |
| Gelatin | 0.8 | — | — | — | — |

TABLE 5-continued

| Composition | Coatings 16 | 17 | 18 | 19 | 20 |
|---|---|---|---|---|---|
| PEA Latex (20%) | 0.6 | — | — | — | — |
| Dimethylolurea (2%) | 6.4 | — | — | — | — |
| Resorcyl Aldehyde (2%) | 3.2 | — | — | — | — |
| Polymer B (20%) | — | 50.0 | 50.0 | 50.0 | 50.0 |
| Glutaraldehyde (25%) | — | 2.0 | 4.0 | — | — |
| Oxybisacetaidehyde (50%) | — | — | — | 0.5 | 1.0 |
| Water | 967.7 | 915 | 913 | 916 | 915 |

The surface electrical resistivity was measured by the procedure described above. The resulting data are reported in Table 6.

TABLE 6

| | Coatings 16 | 17 | 18 | 19 | 20 |
|---|---|---|---|---|---|
| Surface Resistivity (Ohm/sq) | $2 \times 10^{11}$ | $7 \times 10^{9}$ | $7 \times 10^{9}$ | $7 \times 10^{9}$ | $1 \times 10^{10}$ |

The data in Table 6 show the good values of surface resistivity of the coatings 17 to 20 made according to the present invention.

EXAMPLE 5

The conductive coatings 16 to 20 of Example 4 were each overcoated with a gelatin antihalation layer and a gelatin protective layer as described in Example 2 to obtain coatings 21 to 25, respectively. The following Table 7 shows the surface electrical resistivity of the coatings before processing and after processing in 3M RDC5 Developer and the adhesion of the antihalation layer, before processing, after 3M RDC5 Developer, after 3M Fix Roll Fixer and after processing.

TABLE 7

| | Coatings 21 | 22 | 23 | 24 | 25 |
|---|---|---|---|---|---|
| Surface Resistivity (Ohm/sq): | | | | | |
| before processing | $2 \times 10^{13}$ | $7 \times 10^{9}$ | $1 \times 10^{10}$ | $1 \times 10^{10}$ | $2 \times 10^{10}$ |
| after processing | $3 \times 10^{13}$ | $1.5 \times 10^{11}$ | $2 \times 10^{11}$ | $1.5 \times 10^{11}$ | $3.5 \times 10^{11}$ |
| Adhesion: | | | | | |
| before processing | 6 | 5 | 5 | 10 | 8 |
| after developer | 4 | 10 | 10 | 10 | 10 |
| after fixer | 10 | 10 | 10 | 10 | 10 |
| after processing | 6 | 9 | 9 | 10 | 10 |

EXAMPLE 6

The conductive coatings 16 to 20 of Example 4 were overcoated with a gelatin silver halide emulsion layer and a gelatin protective layer as described in Example 3 to obtain the coatings 26 to 30, respectively. The following Table 8 reports the data of surface resistivity of the coatings, adhesion of the emulsion layer before processing, after processing in 3M XDA/3 Developer, after processing in 3M XFA/3 Fixer and after processing, and the photographic fog (D-min) obtained upon processing of coatings 26 to 30.

TABLE 8

| | Coatings | | | | |
|---|---|---|---|---|---|
| | 26 | 27 | 28 | 29 | 30 |
| Surface Resistivity (Ohm/sq) | $9.9 \times 10^{12}$ | $5.6 \times 1010$ | $1 \times 10^{11}$ | $1.7 \times 10^{11}$ | $1.1 \times 10^{11}$ |
| Adhesion: | | | | | |
| before processing | 10 | 10 | 10 | 10 | 10 |
| after developer | 10 | 10 | 10 | 10 | 10 |
| after fixer | 10 | 10 | 10 | 10 | 10 |
| after processing | 10 | 10 | 10 | 10 | 10 |
| D-min after: | | | | | |
| 3 days at 38° C. | 0.210 | 0.200 | 0.200 | 0.200 | 0.200 |
| 5 days at 50° C. | 0.215 | 0.200 | 0.200 | 0.205 | 0.205 |
| 160 minutes at 70° C. | 0.210 | 0.200 | 0.210 | 0.205 | 0.210 |
| 160 minutes at 90° C. | 0.220 | 0.210 | 0.220 | 0.210 | 0.220 |

EXAMPLE 7

The following subbing compositions of Table 9 were prepared and coated as described in Example 1.

TABLE 9

| | Coatings | | | | | |
|---|---|---|---|---|---|---|
| Composition | 31 | 32 | 33 | 34 | 35 | 36 |
| Sulfonated Polyacetal (30%) | 21.3 | 33.0 | 33.0 | 33.0 | 33.0 | 33.0 |
| Gelatin | 0.8 | — | — | — | — | — |
| PEA Latex (20%) | 0.6 | — | — | — | — | — |
| Dimethylolurea (2%) | 6.4 | — | — | — | — | — |
| Resorcyl Aldehyde (2%) | 3.2 | — | — | — | — | — |
| Polymer C (12%) | — | — | 83.0 | 83.0 | 83.0 | 83.0 |
| Polymer D (28%) | — | 35.7 | — | — | — | — |
| Glutaradehyde (25%) | — | 4.0 | 2.0 | 4.0 | — | — |
| Oxybisacetaldehyde (50%) | — | — | — | — | 0.5 | 1.0 |
| Water | 967.7 | 927.3 | 882.0 | 880.0 | 883.5 | 883.0 |

Polymer C is a poly(vinylidene chloride-methylacrylate-itaconic acid) latex containing 88 mole % vinylidene chloride, 10 mole % methylacrylate and 2 mole % itaconic acid.

Polymer D is a poly(vinylidene chloride-ethylacrylate-itaconic acid) latex containing 89 mole % vinylidene chloride, 9 mole % ethylacrylate and 2 mole % itaconic acid.

The surface electrical resistivity was measured by the procedure described above. The resulting data are reported in the following Table 10.

TABLE 10

| | Coatings | | | | | |
|---|---|---|---|---|---|---|
| | 31 | 32 | 33 | 34 | 35 | 36 |
| Surface Resistivity (Ohm/sq) | $2 \times 10^{11}$ | $2 \times 10^{10}$ | $6 \times 10^{9}$ | $7 \times 10^{9}$ | $6 \times 10^{9}$ | $1 \times 10^{10}$ |

EXAMPLE 8

The conductive coatings 31 to 36 of Example 7 were overcoated with a gelatin antihalation layer and a gelatin protective layer as described in Example 2 to obtain coatings 37 to 42, respectively. The following Table 11 reports the surface electrical resistivity of the coatings before and after processing in 3M RDC5 Developer and the adhesion of the antihalation layer before processing, after processing in 3M RDC5 Developer, after processing in 3M Fix Roll Fixer and after processing.

TABLE 11

| | Coatings | | | | | |
|---|---|---|---|---|---|---|
| | 37 | 38 | 39 | 40 | 41 | 42 |
| Surface Resistivity (Ohm/sq): | | | | | | |
| before processing | $2 \times 10^{13}$ | $8 \times 10^{10}$ | $1 \times 10^{10}$ | $7 \times 10^{9}$ | $2 \times 10^{10}$ | $2 \times 10^{10}$ |
| after processing | $3 \times 10^{13}$ | $2 \times 10^{11}$ | $2 \times 10^{11}$ | $1.5 \times 10^{1}$ | $3.5 \times 10^{11}$ | $2 \times 10^{11}$ |
| Adhesion: | | | | | | |
| before processing | 6 | 5 | 9 | 10 | 10 | 10 |
| after developer | 4 | 10 | 8 | 7 | 10 | 10 |
| after fixer | 10 | 10 | 8 | 7 | 10 | 10 |
| after processing | 6 | 9 | 9 | 10 | 8 | 9 |

EXAMPLE 9

The conductive coatings 31 to 36 of Example 7 were overcoated with a gelatin silver halide emulsion layer and a gelatin protective layer as described in Example 3 to obtain the coatings 43 to 48, respectively. The following Table12 reports the data of surface resistivity of the coatings, adhesion of the emulsion layer before processing, after processing in 3M XDA/3 Developer, after processing in 3M XFA3 Fixer and after processing, and the photographic fog (D-min) obtained upon processing of coatings 43 to 48.

TABLE 12

| | Coatings | | | | | |
|---|---|---|---|---|---|---|
| | 43 | 44 | 45 | 46 | 47 | 48 |
| Surface Resistivity (Ohm/sq) | $6 \times 12^{12}$ | $4 \times 10^{10}$ | $7.4 \times 10^{10}$ | $1.2 \times 10^{11}$ | $1.9 \times 10^{11}$ | $1.2 \times 10^{11}$ |
| Adhesion: | | | | | | |
| before processing | 10 | 10 | 10 | 10 | 10 | 9 |
| after processing | 10 | 10 | 7 | 9 | 10 | 10 |
| after fixer | 10 | 10 | 7 | 8 | 10 | 10 |
| after processing | 10 | 10 | 10 | 10 | 10 | 10 |
| D-min after: | | | | | | |
| 3 days at 38° C. | 0.210 | 0.210 | 0.200 | 0.200 | 0.200 | 0.200 |
| 5 days at 50° C. | 0.220 | 0.220 | 0.200 | 0.200 | 0.200 | 0.200 |
| 160 minutes at 70° C. | 0.210 | 0.210 | 0.210 | 0.200 | 0.200 | 0.210 |
| 160 minutes at 90° C. | 0.230 | 0.230 | 0.210 | 0.220 | 0.215 | 0.210 |

We claim:

1. A light-sensitive photographic element comprising a polymeric film base, at least one silver halide emulsion layer, and an antistatic layer comprising (a) a water soluble polyactetal having a viscosity lower than 1.0 dl/g and comprising sulfonated moieties in an amount of at least 50% by weight, (b) a hydrophobic binder selected from the group consisting of a water dispersible sulfopolyester and a latex polymer having hydrophilic groups having hydrophilic functionality, and (c) a aldehyde crosslinking agent having at least two aldehyde groups, adhered to at least one side of said polymeric film base.

2. The light-sensitive photographic element of claim 1 wherein the polymeric film base comprises a polyester film base or a cellulose ester film base.

3. The light-sensitive photographic element of claim 1 wherein the sulfopolyester comprises units represented by the formula:

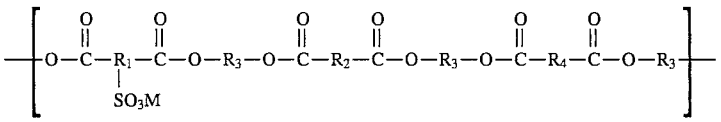

where

M represents an alkali metal cation or ammonium cation, $R_1$ represents a sulfosubstituted arylene or aliphatic group, $R_2$ represents an arylene group, $R_3$ represents an alkylene group, $R_4$ represents an alkylene group or cycloalkylene group.

4. The light-sensitive photographic element of claim 1 wherein the latex polymer is a vinylidene chloride-containing polymer having carboxyl functional groups.

5. The light-sensitive photographic element of claim 1 wherein the latex polymer is a terpolymer of vinylidene chloride, alkyl acrylate and itaconic acid.

6. The light-sensitive photographic element of claim 1 wherein the dry weight ratio of polyacetal to sulfopolyester or polymer latex ranges from 1:0.1 to 1:5.

7. The light-sensitive photographic element of claim 1 wherein the antistatic layer has a dry thickness in the range of 0.1 to 5.0 micrometers.

8. The light-sensitive photographic element of claim 1 wherein the crosslinking agent is oxy-bis-acetaldehyde.

9. The light-sensitive photographic element of claim 1 wherein the silver halide emulsion layer is on the same side of said film base as said antistatic layer.

10. The light-sensitive photographic element of claim 1 wherein the silver halide emulsion layer is on the opposite side of said film base as said antistatic layer.

11. The light-sensitive photographic element of claim 10 wherein an auxiliary gelatin layer is adhered to said antistatic layer.

12. The light-sensitive photographic element of claim 1 wherein said antistatic layer is on only one side of the film base.

13. The light-sensitive photographic element of claim 12 having a silver halide emulsion layer adhered to at least one side of said film base.

14. The light-sensitive photographic element of claim 12 wherein said silver halide emulsion layer is on the same side of said film base as said antistatic layer.

15. The light-sensitive photographic element of claim 12 wherein the silver halide emulsion layer is on the opposite side of said film base as said antistatic layer.

16. The light-sensitive photographic element of claim 15 wherein an auxiliary gelatin layer is adhered to said antistatic layer.

* * * * *